United States Patent [19]

Schnippering et al.

[11] Patent Number: 4,807,423

[45] Date of Patent: Feb. 28, 1989

[54] DEVICE FOR FEEDING COVERS TO A CONTINUOUSLY OPERATING CONTAINER CLOSING MACHINE

[75] Inventors: Horst F. Schnippering, Werdohl-Eveking; Peter Stenzel, Herscheid, both of Fed. Rep. of Germany

[73] Assignee: Alcan International Limited, Quebec, Canada

[21] Appl. No.: 27,654

[22] Filed: Mar. 19, 1987

[30] Foreign Application Priority Data

Mar. 20, 1986 [DE] Fed. Rep. of Germany ..... 3609480

[51] Int. Cl.[4] ..... B65B 7/28

[52] U.S. Cl. ..... 53/296; 53/389

[58] Field of Search ..... 53/286, 296, 297, 298, 53/303, 308, 389

[56] References Cited

U.S. PATENT DOCUMENTS

| | | | |
|---|---|---|---|
| 3,242,639 | 3/1966 | Rosser | 53/389 |
| 3,710,533 | 1/1973 | Burns | 53/389 X |
| 3,716,963 | 2/1973 | Amberg | 53/296 |
| 4,250,686 | 2/1981 | Fujio | 53/296 |
| 4,420,923 | 12/1983 | Moser | 53/389 X |
| 4,466,227 | 8/1984 | Hanscom | 53/389 X |
| 4,604,848 | 8/1986 | Clostermeyer | 53/389 X |
| 4,685,272 | 8/1987 | Kawai et al. | 53/389 |

*Primary Examiner*—James F. Coan
*Assistant Examiner*—Steven P. Weihrouch
*Attorney, Agent, or Firm*—Cooper & Dunham

[57] ABSTRACT

The present invention relates to a device for feeding covers to a continuously operating container closing machine. The device makes it possible continuously to feed covers to closure tools which revolve in a circular path and during their rotary movement descend, for the closing, onto containers moved past below the closing station, so that the closure tools place and close the covers on the containers. For the transfer of the covers, a cover guide path is moved over a certain region of the rotary movement of the closure tool synchronously and in alignment with the closure tools so that the covers can be delivered during this phase to the closure tool.

17 Claims, 5 Drawing Sheets

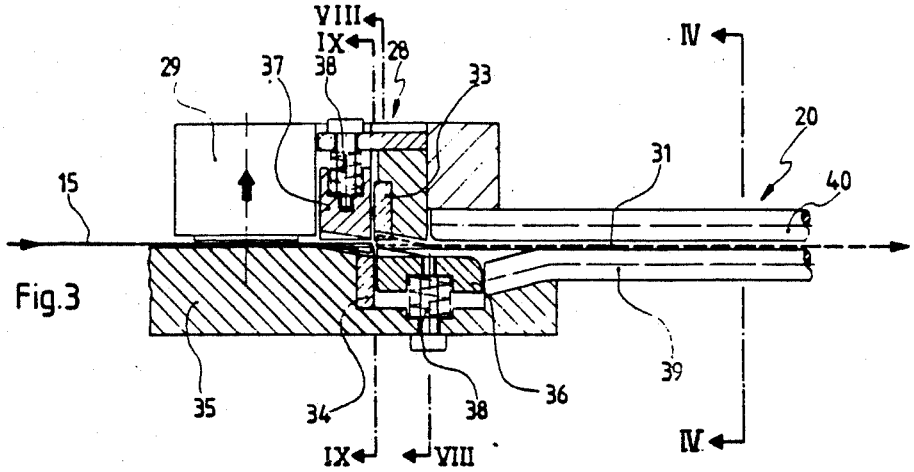
Fig.3
Fig.4
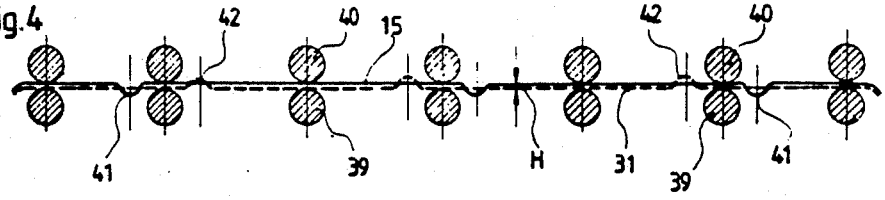
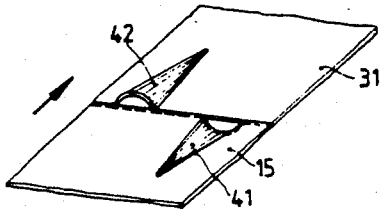
Fig.5
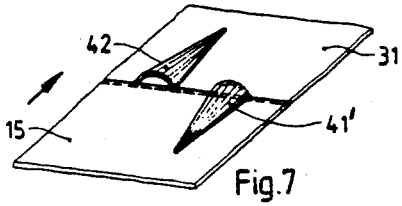
Fig.7
FIG.6
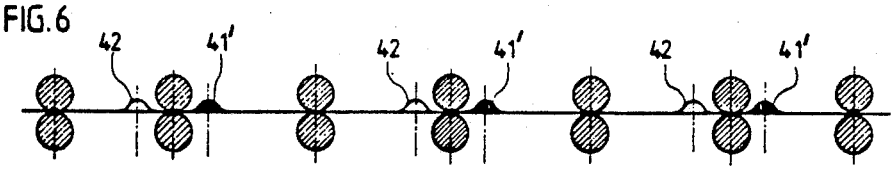
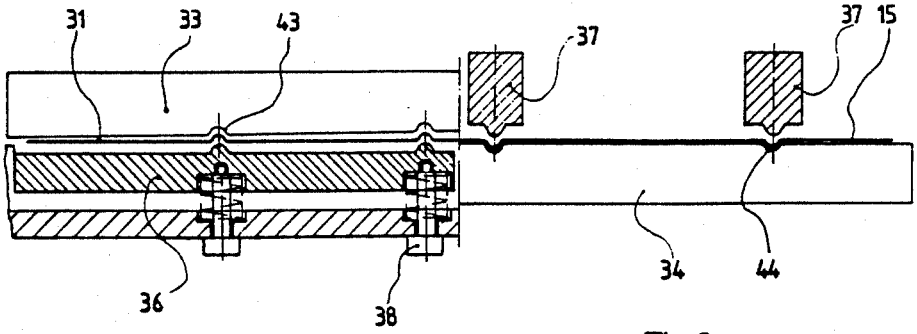
Fig.8
Fig.9

45
46
49'
49
40'
39'
47
47a
48
48a
49''
15
31'
A
B
C
D
E
F
33
34
50
28

Fig.16.
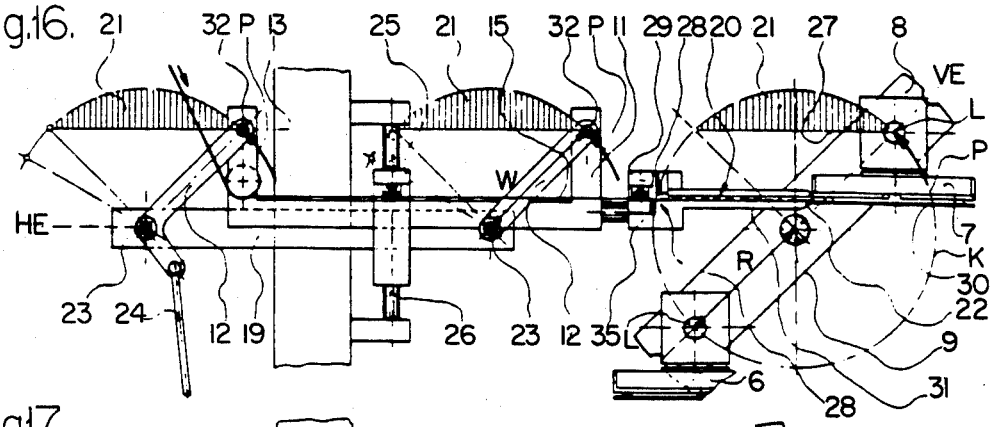
Fig.17.
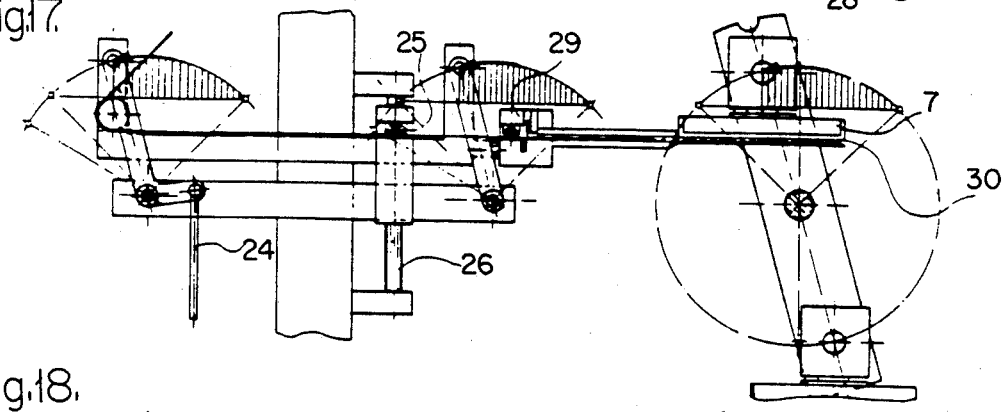
Fig.18.
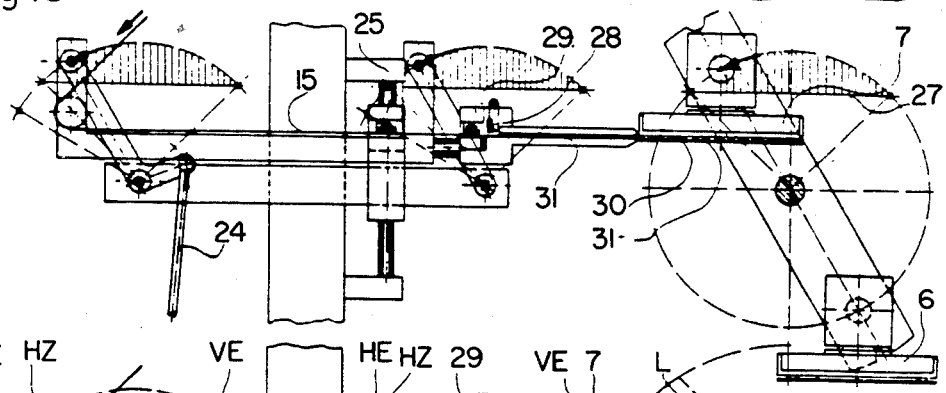
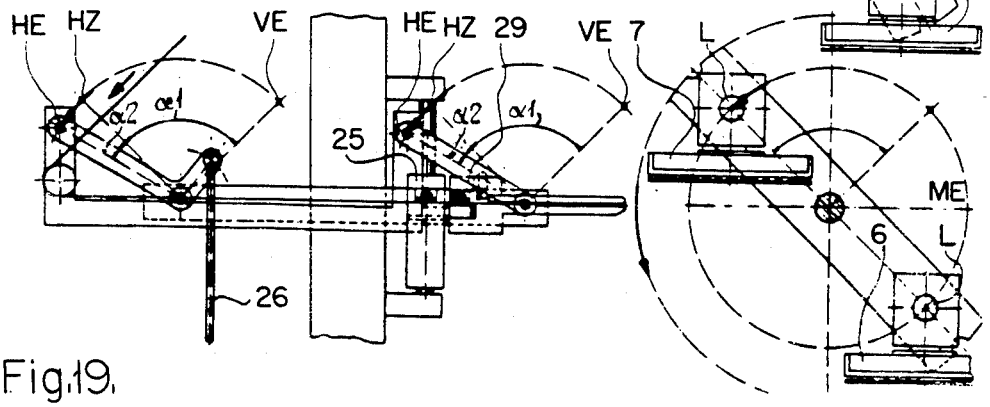
Fig.19.

DEVICE FOR FEEDING COVERS TO A CONTINUOUSLY OPERATING CONTAINER CLOSING MACHINE

The present invention relates to a device for feeding covers to a continuously operating container closing machine, the covers being fastened to the containers by means of at least one closure tool which travels on a tool holder in a circular path while retaining horizontal alignment of the lower surface of the tool.

Such a device is known, for instance, from British Patent No. 923 741. That patent describes a continuously operating container closing machine in which closure tools are moved on a circular path in a rotating tool holder arranged above the transport path. The closure tools are postively guided in such a manner that the lower surfaces of the tools remain horizontally aligned. The individual tools descend periodically onto the individual containers which are moved past below the rotating tool holder and thereby fasten cover foils onto the containers. In that known device the cover foils are loosely fastened on the containers in a separate cover station. The cover station lies in front of the rotating tool holder as seen in the direction of transport. In the station a web of cover foil is removed from a cover foil supply roll. By means of a cutting device, lengths of cover foil are cut from the web of foil and placed more or less loosely on the containers which are transported through the cover station. The containers then travel to the closing station where a closure tool descends and folds the covers, for instance, around a horizontally protruding container rim.

This known device has several disadvantages. On the one hand, it is disadvantageous that the cover foils can be initially placed only loosely on the containers and must then be conveyed over a certain conveyance path up to the actual closing station. This relatively large conveyance path already entails the danger of the covers sliding but it is in particular disadvantageous also in view of the relatively large space required by the complete apparatus because of it.

Another disadvantage of this known system resides in the fact that the closure tools which descend on the containers which have been loosely provided with the covers can, upon the taking up of the containers, also cause displacements of the loosely positioned foil with respect to the container, so that it is necessary in these devices to operate with relatively large protrusions of the cover foils beyond the rims of the containers in order to make certain that the containers are in all cases completely covered when they are closed.

Starting from this prior art, the object of the invention is to provide a device of the aforementioned type which makes it possible to place sparsely dimensioned lids accurately on the containers for the closing of them and which makes a compact construction of the entire closing machine possible.

This object is achieved in accordance with the invention in the manner that a cover guide path is provided which is so arranged that it is swingable over a transfer swing region of the closure tool in the same direction as and in alignment with cover guides on the closure tool and that a cover feed device is provided which pushes the covers from the mouths of the cover guide path into the cover guides on the closure tool upon passage through the transfer swing region.

In accordance with these features, the invention thus contemplates that during their rotation on the tool holder, the closure tools be provided with covers of suitable size in the manner that said covers are pushed into cover guides arranged on the closure tools for this purpose. The closure tools then themselves lower the covers onto the containers so that the containers are thus provided with the covers directly at the place of the closing. Since the closure tools themselves position the covers on the containers, there can be no displacement on transport paths present between them. Since the cover guide path of the transfer device carries out a swinging motion over a certain transfer swing region aligned with the cover guides on the closure tool, sufficient time is thus available to push the covers into the cover guides on the closure tool without the revolving closure tools having to be stopped for this. This permits a rapid and continous loading of the closure tools.

The device of the invention makes it possible to fasten both prefabricated covers and covers which are produced in the device itself uniformly accurately and easily in a continuous movement by means of the closure tools on containers which pass by. since the cover feeding or loading is effected in space in the region of the closure station, the entire closing machine can be of compact construction.

In one advantageous embodiment of the invention the cover guide path is part of a swing frame which is fastened via parallel pendulum arms to a fixed support, the supportside swing axes of the pendulum arms lie in the same horizontal plane as the axis of rotation of the tool holder, and the active length W of the pendulum arms corresponds to the radius R of the circular path of the closure tool. With this development it is possible for the cover guide path to pass in a pendulum movement in the same direction through a swing region with a radius of swing which corresponds to the radius of the circular path of the closure tool. In this way, the aligned arrangement of the cover guide path with the cover guides on the closure tool can be assured in simple fashion over the transfer swing region.

In another embodiment of the invention, in the cover guide path there is arranged a cutting device by which individual pieces of cover foil can be cut off from a web of cover foil. The cutting deive makes it possible to cut cover foil material which is drawn from off a cover foil supply roll into lengths of foil of the size required in each case for one cover and to push these lengths of foil then into the cover guides on the closure tool.

Such a cutting device is, however, not required when the loading is effected with covers which have already been previously produced.

In another embodiment of the invention it is contemplated that embossing elements are arranged in the cutting device and upon the cutting process, produce widthwise staggered end profilings on the cover foil web and the cut length of foil. With such embossing elements the result is obtained that the cut length of foil is pushed, during the passage through the transfer swing region of the cover foil web, out of the cover guide path into the cover guides on the closure tool without separate advancing or driving elements being required for this. The end profilings have the result that the cover foil web and the length of foil which has been cut off do not move over one another but abut at the cut edge in such a manner that the desired pushing out is dependably obtained.

The profiling elements can be so arranged that the end profiling on the cover foil web and the end profiling on the length of foil face in the same direction. While it is also possible, in principle, to have the end profilings on the cover foil web and the length of foil face in different directions, a profiling directed in the same direction serves to prevent in extremely reliable manner the cover foil web and length of foil from sliding over one another after the cutting.

In order to obtain a cleaner, fold-free embossing of the end profiling after the cutting of the cover foil web and the piece of foil, another embodiment of the invention provides for producing one side of the embossing elements, preferably the female side, of an elastic material. When such a material is used, a smooth unprofiled pressing surface is then in itself sufficient.

Another embodiment of the invention provides for developing the cover guide path from the cutting device up to the mouth as a foil bed formed of individual bars. The bars, which are arranged over the width of the foil web, at distances apart alongside each other, in two planes one above the other, thus producing a guide slot, prevent a twisting or sticking of the cut lengths of foil upon the pushing out and transfer into the cover guide on the closure tool. By a suitable selection of the height of the guide slot, which is made only slightly higher than the size of the cover foil, assurance is furthermore had that the end profilings dependably effect the pushing out even if the foil should sag downward somewhat or protrude upward somewhat in partial regions of its cross section.

A modified embodiment of the invention contemplates that, for the formation of a guide slot which commences behind the cutting device as seen in the direction of advance, the cover guide path has upper and lower guide elements which are so developed that the guide slot extends in zig-zag shape in the width-wise direction. In this further development, the above-described embossing of the cut edges in the region of the cutting device by the aid of embossing elements specially provided for this can be dispensed with. Furthermore, the knife used in the cutting device need not then have a ground section which is adapted to the profilings. After introduction into the guide path, the cover foil is shaped in undulated or zig-zag form so that then, after the cut has been effected, a horizontally facing front edge of the web of cover full strikes against a zig-zag rear edge of the piece of cover foil. In this way the following web of foil pushes the cut length of cover foil reliably further within the guide path. If, upon the advancing movement, the web of cover foil is also pushed so far into the guide web that it has passed through a first widened entrance mouth region, it also becomes deformed in zig-zag shape, but nevertheless reliably pushes the cut off piece of cover foil further since, as a result of the stresses in the material, a continuous application against the parts of the guide elements which produce the zig-zag shape is assured, so that the abutting edges cannot slide above or below each other.

As guide elements solid profiled guide plates, staggered round bars or else guide plates with profiled ribs protruding to alternate sides can be used.

Furthermore, in one advantageous embodiment of the invention a clamping device is provided which acts on the web of cover foil and is vertically displaceable with respect to the swing frame but horizontally non-displaceable. If this clamping device is actuated upon reaching the transfer swing region, it holds the web of foil fast so that the web of foil carries out a movement relative to the swing frame upon the swinging of the latter. This relative movement can then be utilized to push out, with the help of the end profilings, the length of foil which has been cut off at the cutting station and at the same time introduce a new piece of foil web for the next piece of foil into the cover guide path. The clamping device, together with the profiling elements, thus permits a simple realization of a cover advancing device.

By means of another clamping device which is swingable vertically and horizontally with the swing frame it is furthermore possible, by corresponding actuation, to pull foil web material off from the cover-foil supply roll when the swing frame is moved from a rear end position, reached after passing through the transfer region, back to the starting point for transfer to a closure tool.

A further development of the invention also contemplates providing a drive for the swing frame which moves the swing frame, upon passage through the transfer swing region, with the corresponding speed of rotation of the tool and in the same direction and which, after passing through the transfer region, swings the swing frame away from the tool with a higher speed. This drive, which makes it possible to swing the swing frame with greater speed out of the path of movement of the closure tool after passing through the transfer region so as to permit free further movement of said tool, can be derived, for instance, by means of a connecting rod from a cam, cam plate or the like which, in its turn, is driven as a function of the cycle time set and thus of the speed of rotation of the closure tools set. In this way, the movements of the swing frame are synchronized with the rotary movements of the closure tool.

In an alternative embodiment to this, for the passage through the transfer swing range, the mouth of the cover guide path is brought against the cover guides of the closure tool and driven against the force of a spring by means of the rotating tool. In this solution there is no independent drive since the swing frame is swung by the closure tools themselves. In this case the spring assures a dependable resting of the mouth of the cover feed path against the closure tool. The passage through a second region of swing after the completion of the transfer with a higher speed can be effected in this connection with control strips which rotate with the rotating tool holder and, by suitable coupling with the swing frame, thus control its movements in synchronism with the rotary movement of the closure tools.

After the tool has left the coupling region with the cover station, the station moves back by spring force—but provided with damping—into the starting position in order to transfer the next cover into the next tool.

In the following the invention will be explained and further described on basis of the embodiment shown in the drawing, in which FIG. 1 shows, in fragmentary view, a closing machine having a feeding device according to the invention, seen in side view;

FIG. 3 is a section through the cutting device;

FIG. 4 is a section along the line IV—IV of FIG. 3;

FIG. 5 shows in perspective the profilings on alternate sides produced on the foil cut edges;

FIG. 6 shows a modified embodiment in section along the line IV—IV of FIG. 3 with profiling on a single side on the foil cut edges;

FIG. 7 shows the profilings obtained with the embodiment of FIG. 6;

FIG. 8 is a section through the cutting device along the line VIII—VIII of FIG. 3;

FIG. 9 is a section through the cutting device along the line IX—IX of FIG. 3;

Figures 10, 11, 12, 13, 14, 14A, 15, 15A:
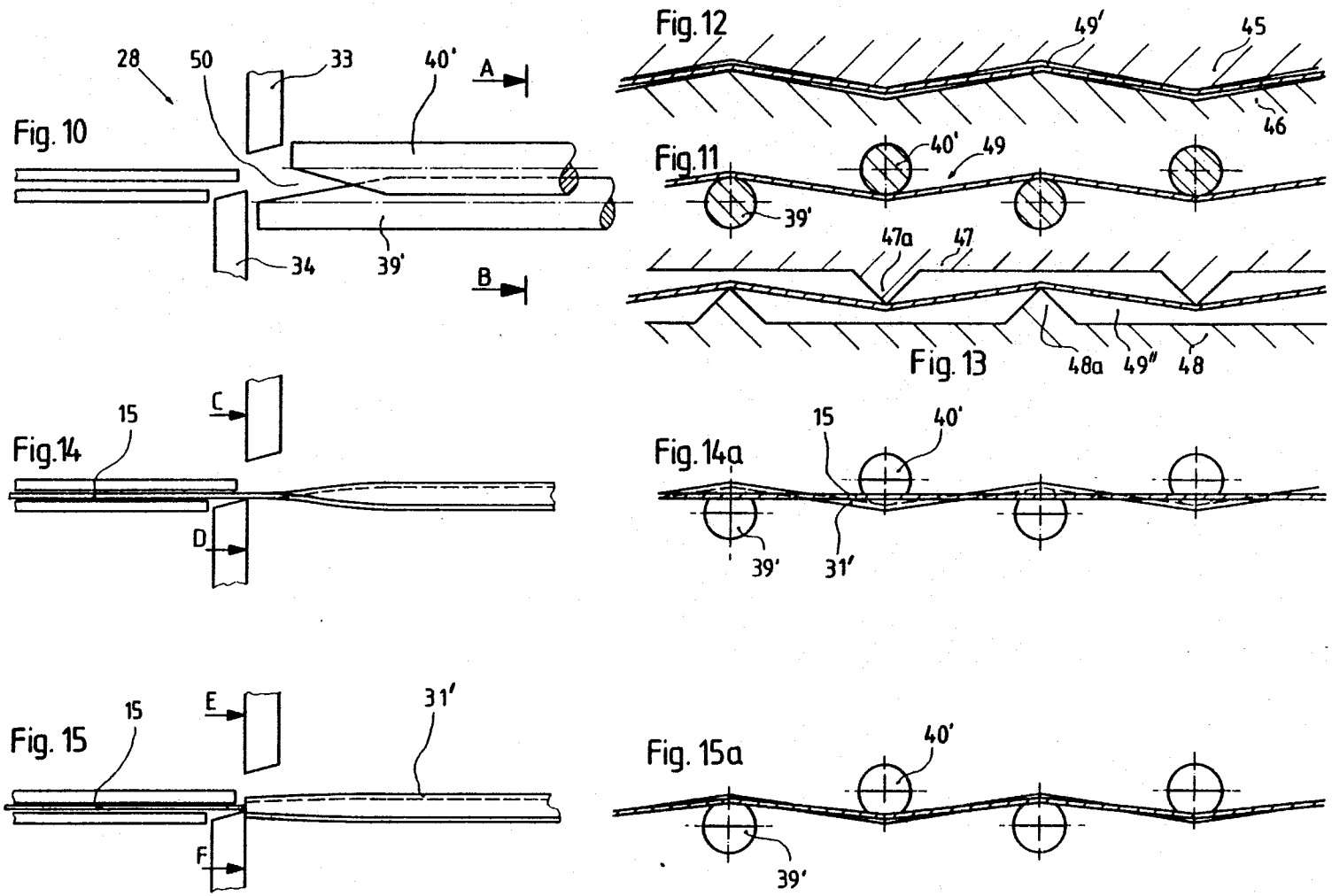
FIG. 10 shows a modified embodiment of the cover guide path with cutting station.
FIG. 11 shows a section along the line A-B of FIG. 10.
FIG. 12 shows a section through the cover guide path of an embodiment which is modified with respect to the guide elements of FIG. 10.
FIG. 13 shows another embodiment of the guide elements, in section.

FIGS. 14 and 14*a* show the course of the cover foil web in front of the cutting before and after introduction into the guide path formed by the guide elements according to FIGS. 12 to 13;

FIGS. 15 and 15*a* show the cover foil and the shape of the piece of cover foil after the cutting, and FIGS. 16 to 19 show the feeding device in different phases of the transfer of pieces of cover foil to the closure tool.

Figure 1:
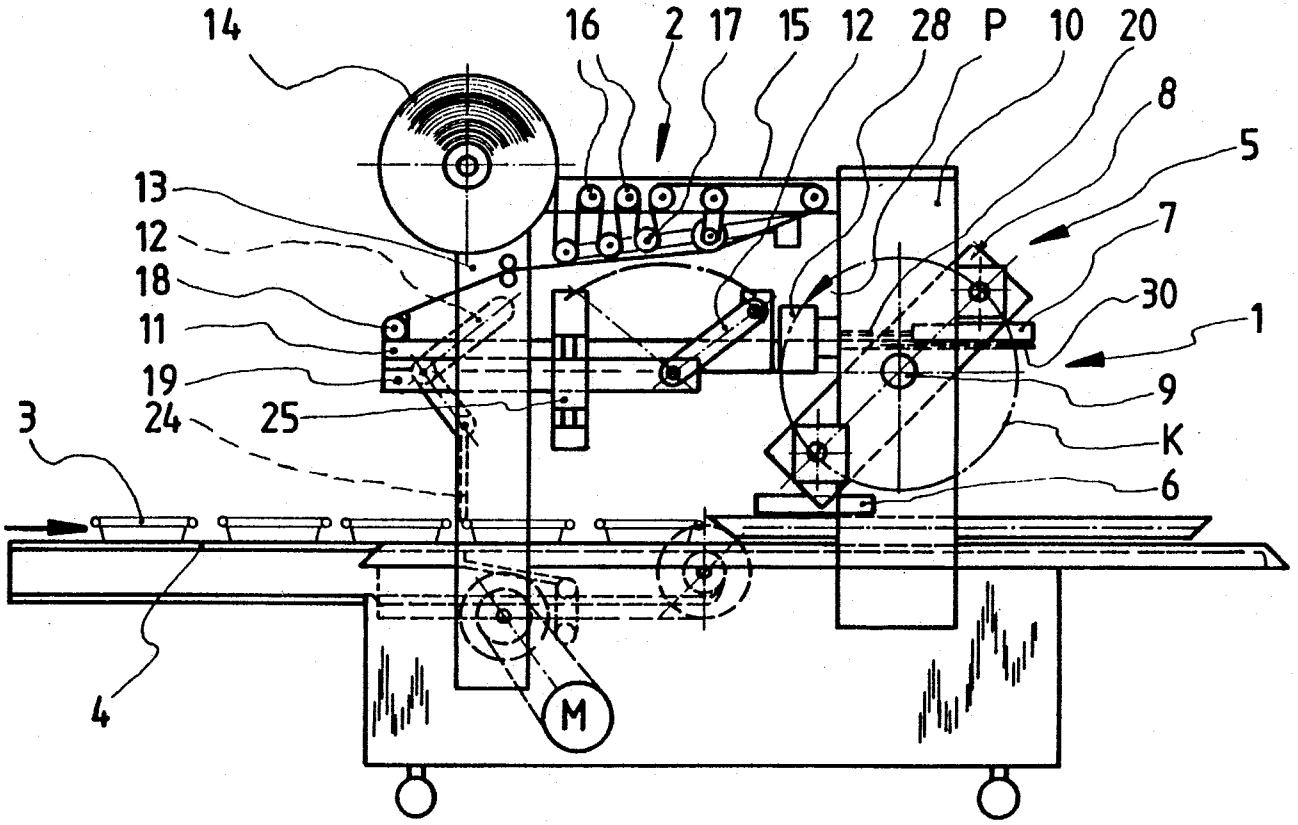

FIG. 1 shows a container closing machine 1 which is provided with a feeding device 2 according to the invention.

The container closing machine has a closure station, designated generally as 5, to which individual containers 3 which are still open and contain, for instance, food are fed, one after the other, by a conveyor belt 4. The containers are moved continuously through the closing machine 1 and are closed at the closing station 5 during their passage.

In the closing station 5, closure tools 6 and 7 move in a circular path K around a central shaft 9 on the arms of the closure tool holder 8 which is developed as a rotary vane. During their revolution on the circular path, the feeding device 2 transfers lengths of cover foil to the individual closure tools. The closure tools then descend onto the containers and close them. The closing process itself does not require any further explanation here. It may merely be pointed out that for the closing, lower tools can also suitably be moved up to the containers, they then cooperating with the closure tools 6 and 7 in such a manner that, for instance, a flange closure is produced under high pressure or else a sealed closure.

The feeding device 2 of the embodiment shown has a swing frame 11 which, with the help of pendulum arms 12 is suspended, with pendulum action through a given region of swing, with respect to a fixed holder 19 which is fastened to a frame 13. This swing frame bears a cover guide path 20 which, by the swinging movement of the swing frame is periodically swung into the circular path K of the closure tool 7 or 6 and is moved, in the same direction on the circular path in alignment with cover guides 30 developed on the tool lower surfaces, during a cover transfer phase.

In the embodiment shown, prefabricated covers are not employed; rather a web of cover foil 15, for example a metal foil, is withdrawn from a cover supply roll 14, the cover foil web being guided over a system of fixed rollers 16, a system of dandy rollers 17 and further suitable guide rollers, and finally over a reversal roller 18 on the swing frame and conveyed in the direction towards the cover guide path 20.

From this cover foil web 15, suitable lengths of foil as required for the closing of the containers are separated by means of the cutting device 28 which is further described below and transferred into the closure tools 6 and 7.

Figure 2:
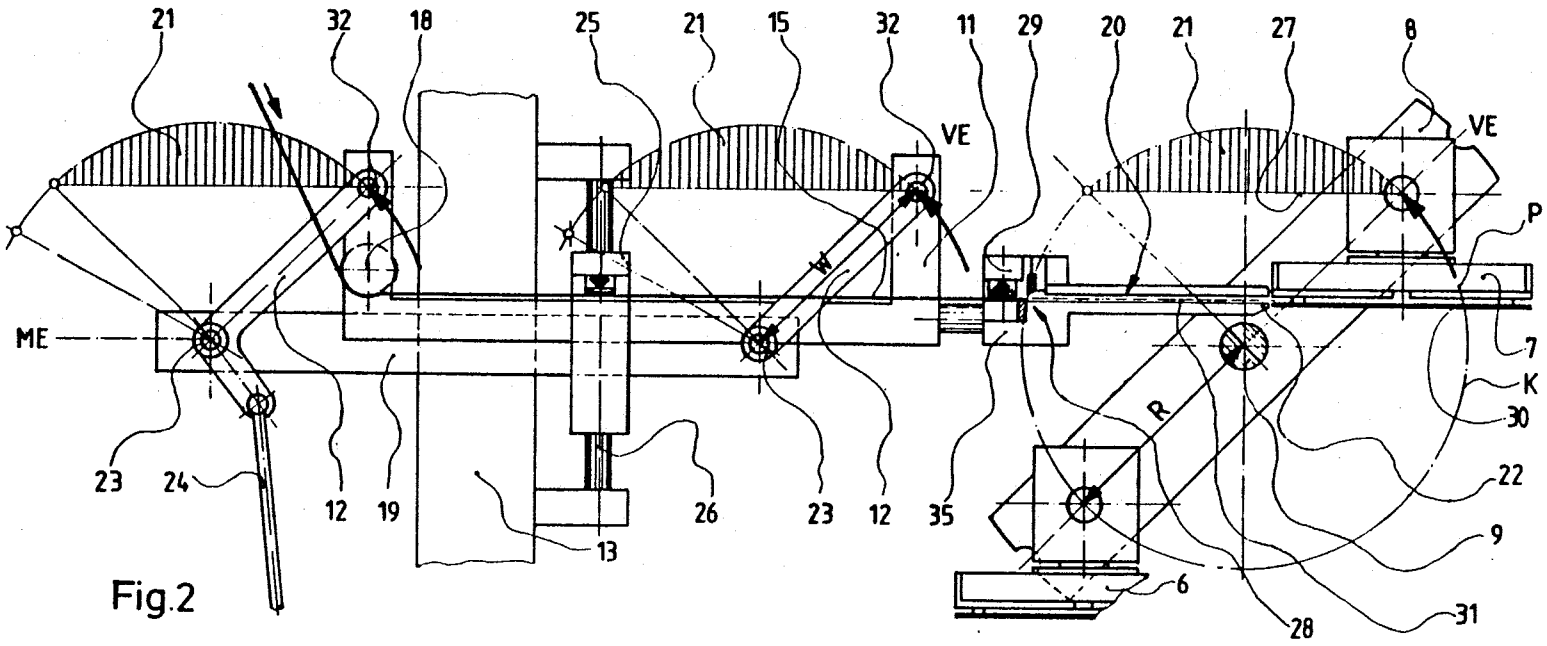
FIG. 2 shows, in an enlarged fragmentary view, a side view of the feeding station.

The feeding station will be described in further detail below with reference to FIG. 2.

On the frame 13 to which the fixed support 19 of the swing frame 11 is fastened there is also arranged a clamping device 25. The clamping device can, upon actuation, hold the cover sheet web fast so that it can no longer move horizontally with respect to the clamping device. The clamping device 25 itself is fastened in horizontally nondisplaceable but vertically displaceable fashion via the guide bar 26 on the frame 13. On the tool holder end, the swing frame passes into (a structural unit or) a mount 35 within which a further clamping device 29 and a cutting device 28 are arranged. From the cutting device 28, there extends a cover guide path 20 the mouth 22 of which, in the position shown, is flush with and in horizontal alignment with the tool bottom of the closure tool 7 with the cover guides 30 arranged there. The closure tools 6 and 7 are mounted in the closure tool holder in each case with a spacing R (radius of the circular path K) in such a manner that the tool bottom surfaces and thus also the cover guides are always horizontal. The effective length W of the pendulum arms 12 by which the swing frame 11 is fastened with respect to the fixed support 19 corresponds to the radius R of the rotating closure tools. The axes 23 of the pendulum arms 12 lie in a common horizontal plane ME with the central shaft 9 of the tool holder. This development and the parallelogram-like suspension of the swing frame has the result that from the swivel bearings 32 of the swing frame, on the one hand, and from the mounting point of the closure tool 7, the transfer swing regions 21 can be passed through in the same direction and the cover guide path 20 is moved synchronously and in alignment with the cover guides 30. During this synchronously traversed transfer swing region, a piece of cover foil 31 which has been cut off from the cover foil web 16 at the cutting station 28 can be transferred into the cover guide 30 of the closure tool 7 or of the closure tool 6, when it has reached the corresponding position. the driving of the swinging movement of the swing frame, which is synchronous with the movement of rotation of the closure tool, is effected in the embodiment shown by means of a connecting rod 24 which acts on one of the pendulum arms 12 which, in its turn, is coupled by means of suitable drive elements to the drive M (see FIG. 1) which, in a manner not further described, also drives the tool holder.

The cutting device 28 will now be explained in further detail with reference to FIG. 3. The cutting device is arranged in the mount 35 and has a vertically movable upper knife 33 and a lower knife 34 which is fixed in the mount and suitably staggered with respect to the upper knife. By the lowering of the upper knife the cover foil web is cut at the cutting place. A profiling ledge 36 arranged below the pushthrough path of the cover foil is associated with the upper knife 33 while the pressure pieces 37 are associated as abutment with the lower knife 34. Both the profiling ledge 36 and the pressure pieces 37 are supported via springs 38. The profiling strip 36, the pressure pieces 37 and profiling depressions 43 and 44 introduced in the cutting edges of the upper and lower knife produce, during the effecting of the cut, end profilings 41 and 42 on the separated piece of cover foil 31 on the one hand, and on the foil web 16 on the other hand.

The profilings are shown in two different embodiments in FIGS. 4 to 7. In this connection, in the embodiment shown in FIG. 4 the end profiling is effected in such a manner that profilings 41 and 42 which are staggered in width-wise direction are produced, the profiling in the cover sheet length 31 facing upward while in the cover foil web 15 it faces downward (See FIG. 5). In another embodiment, as can be noted from FIGS. 6 and 7, the profilings 41' and 42 face in the same direction in the web of cover foil and the cover foil piece. In particular, from FIGS. 4 and 6 it can furthermore be noted that the cover guide path is formed by individual bars 39 and 40 which are spaced from each other and arranged with the formation of a guide slot of the height H. The guide slot H (See FIG. 4) is selected only slightly larger than the thickness of the cover foil so that the cover foil web cannot push over the cut length of cover foil. The profilings can rather be used to reliably push out the cut length of cover foil. The solution shown in FIG. 6 has been found to be particularly advantageous since it can effect a further pushing forward of the cut length of foil even if the latter should sag downward or protrude upward in cross section.

On basis of FIGS. 10 to 15*a*, alternative embodiments for the development of the cover guide web with the cutting device will be explained below. In these alternative embodiments, knives are used which are not specially profiled but produce smooth cuts. The reliable advance is assured in the manner that the guide slot 49 (FIG. 11) or 49' (FIG. 12) or 49'' (FIG. 13) which follows the cutting device 28 is developed with a zig-zag course. This is achieved, in accordance with the embodiment of FIG. 11, by lower and upper round bars 39', 40' staggered in vertical direction, in the embodiment of FIG. 12 by upper and lower profiled guide plates 45, 46, and in the embodiment of FIG. 13 in each case in similar manner by guide plates 47 and 48 with profiled ribs 47*a*, 48*a* protruding in opposite directions. Directly behind the cutting device 28 there is provided in all embodiments (this is shown in FIG. 10 only for the round bars) a widened inlet mouth 50 which reliably conducts the entering foil web into the guide slot 49 or 49' or 49''.

FIG. 14, which omits the upper and lower guide elements, shows a cover foild web 15 fed between these elements in front of and behind the cutting device, still before the effecting of the cut. As can be noted from the sectional showing in FIG. 14*a* (the round bars 39', 40' are shown there), the web of cover foil 15 is still almost unprofiled in the region of the knife and then passes between the guide bars into the more strongly profiled cover 31' which is not yet cut off. After the effecting of the cut by the separating knife, the cut off length 31' of cover foil assumes the shape which can be noted from FIGS. 15 and 15*a*. Corresponding to the profiling by the guide elements (in this case the round bars 39', 40'), the region of the cover directly behind the cutting knife arrangement at the height of the inlet opening 50 has, due to the elasticity of the material (metal foil), also assumed a profiling, but in still weakened form.

If upon the next operating cycle the cover sheet web 15 is displaced, its initially straight end edge comes against the profiled end edge of the cover 31', which is thereby pushed further into the guide path. After the end edge of the cover foil path 15 has passed the entrance mouth 50 between the round rods 39', 40', it is itself profiled and in the further course of the advance the following parts are also profiled. Since the foil, by its elasticity, opposes resistance to the deformation, it will place itself taut against the round bars 39', 40' (or against the parts of the guide path producing the zig-zag shape) and is therefore able to push the cover foil length 31' forward without it sliding over or under the cover 31'.

Such sliding under or over of the foil length is avoided, in particular, in the manner that by the clamping zig-zag guidance the length of foil have the same horizontal position in a sufficient number of points within their thickness dimension. It is clear that the guide elements are arranged in such a manner that the center line of the zig-zag slot lies at the level of the horizontal plane of the cover sheet web entering the cutting device 28.

The advance would in itself also be obtainable by a flat guide slot which is no wider than the foils are thick. Such a construction would, however, be more expensive and probably more trouble-prone in operation.

The manner of operation of the feeding device will now be described with reference to FIGS. 16 to 19. FIG. 16 shows (in the same way as FIG. 2) the starting position of the transfer process of a length of cover foil 31 (shown in dashed line in the figures) which has already been cut off by the cutting device 28 from the cover foil web 15. The cutting device 28 is now opened as is the clamping device 29. On the other hand, the clamping device 25 is closed. The pendulum arms 12 are in a front end position VE. The closure tool 7 present on its circular path in the direction of the arrow P in counterclockwise direction has reached a possible starting point 5 of the transfer of the cover. In this position the cover guide path 20 is aligned with the cover guides 30 of the closure tool 7. The swing frame 11 is now swung in the direction indicated by the arrow P synchronously with the further moving closure tool 7 by the pendulum arms 12 driven by the connecting rod 24, it retaining the horizontal alignment with respect to the closure tool 7 during the passage through the hatched transfer swing region 21. Since the clamping device 25 holds the cover foil web fast but, on the other hand, the swing frame shifts to the left in the drawing with respect to the foil path, the end profilings now have the result that the cover foil web pushes the front section 31 from the cover guide path 20 which is moving away towards the left in a rotary movement into the cover guides on the closure tool 7.

In the position shown in FIG. 17, the foil length has already entered into the cover guides 30 of the upper tool to the extent of about ¾ of its total length, while the clamping device 25 is still closed. The vertical component of the pendulum movement of the swing frame in the region of the clamping device 25 has been transferred from it by means not shown in the drawing to the vertical guide on the guide bars 26 of the clamping device 25. The idler system 17 (FIG. 1) effects in a compensating of the influences of the pendulum movement on the cover foil and sees to a uniform tensioning of the cover foil web.

In FIG. 18, the end position of the transfer process is now reached. The length of cover foil 31 is pushed into the guides of the closure tool 7. The support guides, which can also be provided with suitable clamping elements in order to hold the foil length fast in its position, have now taken over the length of foil and guide it together with the closure tool 7 upon the following lowering movement to a container which has then reached the closing station. On basis of the clamping action of the clamping device 25, a new length of cover foil 31' which, however, is still not separated from the cover foil web, is already present in the foil bed formed by the bars 39 and 40. The cutting device 28 is preferably actuated only when the starting position of FIG. 16 has again been reached. In the phase now reached in FIG. 18, after the transfer of the cover foil section, the clamping device 29 now closes while the clamping device 25 opens.

In FIG. 19, another phase after the effecting of the transfer is shown. In this case the angle 1 designates a range of swing which has, for instance, been moved through while the angle 2 is intended to designate an angle section which is passed through by the loading system in accelerated manner after the transfer has taken place so as to obtain sufficient distance from the closure tool 7 during the further rotation thereof. When the bearing points L of the closure tools 6 and 7 are still in front of the horizontal central plane ME as seen in the direction of rotation, the movement of the swing frame commences from its rear end position HE in the direction towards the front end position VE, which it reaches when the next closure tool 6 has reached approximately the position shown for tool 7 in FIG. 16. During this movement the clamping device 29 is closed and the clamping device 25 opened, so that a further piece of cover sheet web corresponding to the length of the next piece of cover sheet 31 required is pulled off from the supply roll 14. The longest possible length of cover foil 31 corresponds to the chord 27 of the transfer swing region 31. The required size of the length of cover sheet as a function of the size of the closure tool and thus of the container to be closed can be effected by a path-dependent or angle-dependent control of the clamping devices 25 and 29. The clamping devices themselves can be driven mechanically, pneumatically, hydraulically, electromagnetically or electrically. Depending on the adjustment of the control, the transfer of the cover sheet length 31 can thus be located at the beginning or in any desired region between the beginning and end of the possible transfer swing region 21. While the tool holder now moves continuously on a circular path, the swing frame oscillates, as shown, around the swing axes 23. Depending on the control, a stop or waiting time can be programmed in the end positions VE and HE but standstill can, however, also be dispensed with in order to permit the free movement phase, for instance in the direction from HE to VE, to take place as slowly as possible. The speed of movement from VE to HE is substantially, at least, however, during the transfer of the cover foil in the region of the angle 1, coupled to the speed of the closure tool. This speed is adjusted by means not shown in detail by varying the speed of rotation. Synchronous drive as a function of the adjusted cycle time can be assured via the connecting rod by controlling same by means of a crank, cam or the like.

We claim:

1. A device for feeding covers to a continuously operating container closing machine including at least one closure tool for fastening the covers to containers, and a tool holder supporting said one closure tool for revolution of said one closure tool in a circular path, said one closure tool having cover guides for receiving a cover and revolving in said circular path while retaining a horizontal alignment of its under surfaces, said device comprising:

(a) means for defining a cover guide path, having a mouth for discharging a cover and swingable in an arcuate path, over a transfer swing region of the path of revolution of said one closure tool, in the same direction as and in flush alignment with said cover guides on said one closure tool; and (b) cover feed means, operatively associated with said cover-guide-path-defining means, for pushing a cover from the mouth of the cover guide path into the cover guides on said one closure tool upon swinging of said cover-guide-path-defining means through said transfer swing region.

2. A device according to claim 1, further including a swing frame, a fixed support, and parallel pendulum arms swingably fastening said swing frame to said fixed support, said cover-guide-path-defining means being a part of said swing frame; wherein the pendulum arms are swingable, relative to the fixed support, about axes lying in a common horizontal plane; wherein said closure tool revolves about an axis of rotation lying in said horizontal plane; and wherein each of the pendulum arms has an effective length equal to the radius of the circular path of the closure tool.

3. A device according to claim 2, further including a cutting device for cutting off individual cover foil lengths from a cover foil web, said cutting device being arranged in the cover guide path (20).

4. A device according to claim 3, further including embossing elements arranged in the cutting device for producing, each time a cover foil length is cut off as aforesaid, end profilings staggered in width-wise direction on the cover sheet web and the cover foil length which has been cut off.

5. A device according to claim 4, wherein the embossing elements are so arranged that the end profilings on the cover foil web and on the length of cover foil face in opposite directions.

6. A device according to claim 4, wherein the embossing elements are so arranged that the end profilings on the cover foil web and on the length of cover foil face in the same diraection.

7. A device according to claim 4, wherein at least one side of the embossing elements is made of an elastic material.

8. A device according to claim 3, wherein the cover -guide- path -defining means comprises a plurality of individual rods forming a foil bed extending from the cutting device up to the mouth.

9. A device according to claim 3, wherein the cover-guide-pathdefining means includes upper and lower guide elements forming a guide slot which commences beyond the cutting device in the direction of advance of covers,s aid guide elements being so arranged that the guide slot extends in zig-zag shape transversely of the cover guide path.

10. A device according to claim 9, wherein the guide elements define an inlet mouth which widens towards the cutting device.

11. A device according to claim 9, wherein said guide elements are solid profiled guide plates.

12. A device according to claim 9, wherein said guide elements are round bars which are staggered with respect to each other in a vertical direction.

13. A device according to claim 9, wherein said guide elements are guide plates having profile ribs which protrude in opposite directions.

14. A device according to claim 2, wherein said cover feed means includes a clamping device for clamping a cover foil web adjacent the swing frame to hold the web against movement therewith and which is displaceable vertically with respect to the swing frame but undisplaceable horizontally.

15. A device according to claim 14, further including a second clamping device for clamping the foil web, said second device being horizontally and vertically swingable and connected to the swing frame.

16. A device according to claim 2, further including a drive for the swing frame, which moves the swing frame, during swinging of the cover-guide-path-defining means through the transfer swing region, in the same direction and with the same speed of rotation as said one closure tool, and which, after the cover-guide-path-defining means has passed through the transfer swing range, swings the swing frame away from the closure tool with a higher speed.

17. A device according to claim 2, wherein, during passage through the transfer swing region, the mouth of the cover guide path is brought to rest against the cover guides of the closure tool; and further including a spring, against the force of which the cover-guide-pathdefining means is driven by said one closure tool as said one tool rotates.

* * * * *